US006239756B1

(12) United States Patent
Proctor, Jr. et al.

(10) Patent No.: US 6,239,756 B1
(45) Date of Patent: May 29, 2001

(54) ANTENNA ARRAY WITH HOUSING

(75) Inventors: James A. Proctor, Jr., Indialantic; Kenneth M. Gainey, Satellite Beach; William R. Palmer, Melbourne, all of FL (US)

(73) Assignee: Tantivy Communications, Melbourne, FL (US)

( * ) Notice: Subject to any disclaimer, the term of this patent is extended or adjusted under 35 U.S.C. 154(b) by 0 days.

(21) Appl. No.: 09/443,730

(22) Filed: Nov. 19, 1999

(51) Int. Cl.[7] ..... H01Q 1/24
(52) U.S. Cl. ..... 343/702; 343/872; 343/901
(58) Field of Search ..... 343/702, 901, 343/872, 893; 455/89, 90

(56) References Cited

U.S. PATENT DOCUMENTS

| | | | | |
|---|---|---|---|---|
| 4,475,323 | | 10/1984 | Schwartzberg et al. | 52/111 |
| 4,593,290 | | 6/1986 | Wojtowicz | 343/900 |
| 5,196,857 | | 3/1993 | Chiappetta et al. | 343/881 |
| 5,239,793 | | 8/1993 | Chiappetta et al. | 52/108 |
| 5,337,061 | * | 8/1994 | Pye et al. | 343/702 |
| 5,561,436 | | 10/1996 | Phillips | 343/702 |
| 5,561,437 | | 10/1996 | Phillips et al. | 343/702 |
| 5,572,223 | | 11/1996 | Phillips et al. | 343/702 |
| 5,642,122 | | 6/1997 | Lockie et al. | 343/881 |
| 5,995,052 | * | 11/1999 | Sadler et al. | 343/702 |
| 6,031,495 | * | 2/2000 | Simmons et al. | 343/702 |
| 6,091,369 | * | 7/2000 | Baek et al. | 343/702 |

FOREIGN PATENT DOCUMENTS 2 293 274 3/1996 (GB) .

* cited by examiner

*Primary Examiner*—Tan Ho
(74) *Attorney, Agent, or Firm*—Hamilton, Brook, Smith & Reynolds, P.C.

(57) ABSTRACT

The invention relates to an antenna array used with a wireless subscriber unit. The antenna array can have a plurality of antenna elements attached to a housing. Expanding or collapsing the housing can move the antenna elements into an expanded or a collapsed state, respectively.

26 Claims, 8 Drawing Sheets

ANTENNA ARRAY WITH HOUSING

BACKGROUND OF THE INVENTION

It is increasingly common for wireless communication systems to use digital modulation schemes such as Code Division Multiple Access (CDMA) to establish physical communication channels between a base station and one or more mobile subscriber units. The base station is typically a computer controlled set of transceivers that are interconnected to a land-based public switched telephone network (PSTN). The base station includes an antenna apparatus for sending radio frequency signals to the mobile subscriber units, a direction known as the forward link. The base station antenna is also responsible for receiving reverse link radio frequency signals transmitted from each mobile unit.

Each mobile subscriber unit also contains an antenna apparatus for the reception of the forward link signals and for transmission of the reverse link signals. A typical mobile subscriber unit is a digital cellular telephone handset or a personal computer coupled to a cellular modem. In CDMA cellular systems, multiple mobile subscriber units may transmit and receive signals on the same frequency but with different codes, to permit detection of signals on a per unit basis.

The most common type of antenna used to transmit and receive signals at a mobile subscriber unit is a mono- or omni-pole antenna. This type of antenna consists of a single wire or antenna element that is coupled to a transceiver within the subscriber unit. The transceiver receives reverse link signals to be transmitted from circuitry within the subscriber unit and modulates the signals onto the antenna element at a specific frequency assigned to that subscriber unit. Forward link signals received by the antenna element at a specific frequency are demodulated by the transceiver and supplied to processing circuitry within the subscriber unit.

A second type of antenna which may be used by mobile subscriber units is described in U.S. Pat. No. 5,617,102. The system described therein provides a directional antenna comprising two antenna elements mounted on the outer case of a laptop computer. The system includes a phase shifter attached to the two elements. The phase shifter may be switched on or off in order to effect the phase of signals transmitted or received during communications to and from the computer. By switching the phase shifter on, the antenna transmit pattern may be adapted to a predetermined hemispherical pattern which provides transmit beam pattern areas having a concentrated signal strength or gain. The dual element antenna directs the signal into predetermined quadrants or hemispheres to allow for large changes in orientation relative to the base station while minimizing signal loss.

A third type of antenna which may be used by mobile subscriber units includes multiple antenna elements and a like number of adjustable phase shifters, each respectively coupled to one of the antenna elements. The phase shifters are independently adjustable (i.e., programmable) to affect the phase of respective reverse link signals to be transmitted from the subscriber unit on each of the antenna elements. The antenna apparatus acts as a beamformer for transmission of signals from the subscriber unit and acts as a directive antenna for signals received by the subscriber unit.

While the antenna of the subscriber units allow a user mobility, the antenna apparatus itself can have several shortcomings. Without a protective covering, the antenna elements of the antenna apparatus would be exposed to dust and dirt from the environment. Similarly, a lack of a protective covering or housing for the antenna would expose the antenna to the risk of breakage during transport. Another shortcoming involves the situation where an antenna apparatus unit has multiple antenna which are each fairly long. Such antenna apparatus are not especially convenient for the mobile user to set up and tear down.

SUMMARY OF THE INVENTION

The present invention relates to an antenna assembly for use with a wireless subscriber unit having a housing with a top housing portion and a bottom housing portion and a plurality of antenna elements. In one embodiment, a top portion of the antenna elements are attached to the top housing portion and a bottom portion of the antenna elements are slidably mounted within the bottom housing portion. In another embodiment, a top portion of the antenna elements are attached to the top housing portion and a bottom portion of the antenna elements are fixedly attached to the bottom housing portion. With these embodiments, expanding or collapsing the top and bottom housing portions relative to each other will cause the antenna elements to expand or collapse.

In one embodiment, the antenna assembly has at least one circuit board mounted within the housing. The antenna assembly can include a captive antenna circuit board, a captive modem controller circuit board and a captive transceiver circuit board in an alternate embodiment. In another embodiment, the components which form the captive antenna circuit board, captive modem controller circuit board and captive transceiver circuit board can all be mounted to a single circuit board. The antenna assembly can have at least one port to connect the antenna to an external device, such as a computer or a power source.

The antenna assembly can have a first securing mechanism to secure the top housing portion to the bottom housing portion when the antenna assembly is closed. The antenna assembly can also have a second securing mechanism to secure the top housing portion away from the bottom housing portion when the antenna assembly is opened. When opened, the antenna assembly can allow for the operation of standard cellular and personal communication services (PCS).

When the antenna assembly is closed, the antenna assembly can have a thickness of between 1.25 inches and 1.4 inches. Preferably, the antenna assembly has a thickness of 1.37 inches when closed. The width of the antenna assembly can be between 3.93 and 5.93 inches and can have a preferred width of 4.93 inches.

The plurality of antenna elements can have a plurality of captivating sleeves. In one embodiment, the plurality of antenna elements has five antenna elements. A first antenna, a second antenna, a third antenna and a fourth antenna can be positioned within the housing at locations corresponding to the comers of a square. A fifth antenna can be positioned within the housing at a location corresponding to the center of a square. In an alternate embodiment, the plurality of antenna elements has four elements, each positioned within the housing at locations corresponding to the four comers of a square. In this alternate embodiment, the size of the four antennae is smaller along the longitudinal axis and radial axis, compared to the size of the antennae when the plurality of antenna elements has five antenna elements. The antenna elements can have a range of motion between 0.48 inches and 1.28 inches, with a preferred range of motion of 0.88 inches.

In one embodiment, the antenna elements are continuous rods. In an alternate embodiment, the antenna elements comprise telescoping antenna. In another embodiment, the plurality of antenna elements are made from a flex circuit material. The flex circuit material can be formed into accordion antennae. In this embodiment, the antenna assembly can also have a plurality of support rails.

The invention also relates to a method of operating an antenna assembly for use with a wireless subscriber unit. This method comprises the steps of providing an antenna assembly, expanding the antenna assembly comprising a housing and a plurality of antenna elements, using the antenna assembly with a wireless subscriber unit, and collapsing the antenna assembly.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
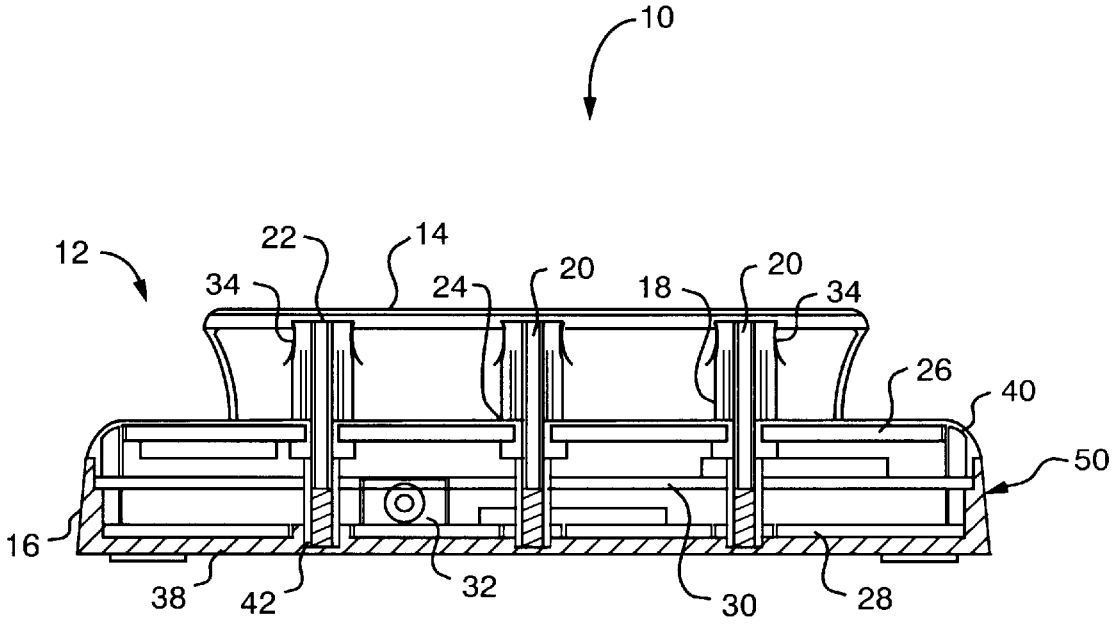
FIG. 1 illustrates a cross sectional view of an embodiment of an antenna assembly in a closed position.
Figure 2:
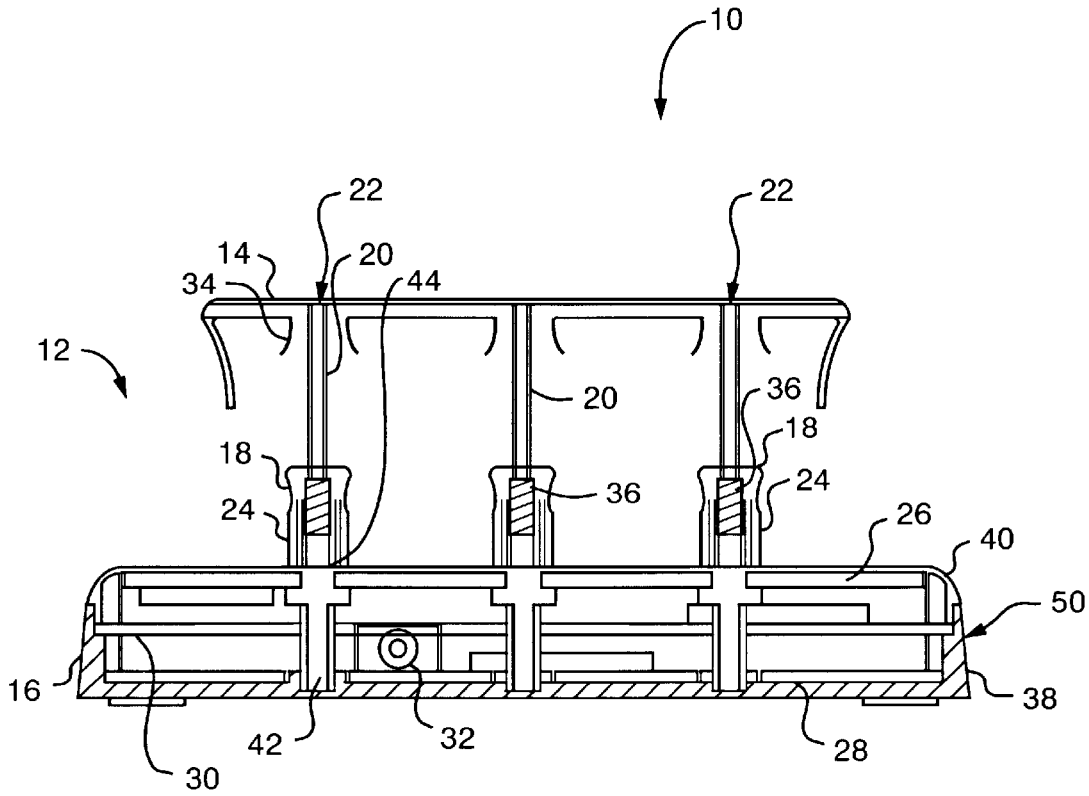
FIG. 2 shows a cross sectional view of an embodiment of an antenna assembly in an open position.

FIGS. 1 and 2 illustrate one embodiment of an antenna assembly 10. FIG. 1 shows an embodiment of the assembly 10 in a closed position and FIG. 2 shows an embodiment of the assembly 10 in an open position. The antenna assembly 10, according to the invention, has a plurality of antenna elements 20, contained within a plurality of captivating sleeves 18, and a housing 12 having a top housing portion 14 and a bottom housing portion 16. The housing 12 can contain at least one circuit board. The circuit board can be either a captive antenna circuit board, a captive modem controller circuit board or a captive transceiver circuit board. In a preferred embodiment, the housing 12 contains a captive antenna circuit board 26, a captive modem controller circuit board 28 and a captive transceiver circuit board 30 simultaneously. In an alternate embodiment, the components which form the captive antenna circuit board, captive modem controller circuit board and captive transceiver circuit board can all be mounted to a single circuit board which can be located within the housing 12.

The captive antenna circuit board 26 may contain, for example, phase shift elements used to focus the electromagnetic patterns produced by the antenna elements 18. The phase shifters can be independently adjustable to affect the directionality of signals to be transmitted and/or received to or from a subscriber unit, such as a laptop computer. By properly adjusting the phase for each of the plurality of antenna elements 18 during signal transmission, a composite beam can be formed which may be positionally directed towards a base station. In other words, a directional antenna is formed by independently adjusting the phase of each of the plurality of antenna elements 20.

The captive transceiver circuit board 30 can couple the antenna assembly 10 to a subscriber unit, such as a laptop computer. The antenna elements 20 allow the laptop computer to perform wireless data communications via forward link signals transmitted from a base station and reverse link signals transmitted to a base station.

The captive modem controller circuit board 28 can modulate and demodulate base band data. The modem controller circuit board 28 can control the flow of information to and from a computer.

The housing can also contain at least one port 32 which can connect the antenna assembly 10 to an external device. In a preferred embodiment, the port 32 is a data port which can connect the antenna assembly 10 to an external computer. In this embodiment, the port 32 can provide an ethernet connection, for example. The data port can also provide power to the assembly 10 from the external device. In an alternate embodiment, the port 32 is a power port which can connect the antenna assembly 10 to an external power source. In another embodiment, both a data port and a power port can be used in the assembly 10.

The plurality of antenna elements 20 can be slidably mounted within the assembly 10 and contained within a plurality of captivating sleeves 18. The antenna elements 20 are made from a signal conducting material. In a preferred embodiment, the captivating sleeves 18 are made from a non-signal conducting material, such as plastic for example.

The plurality of antenna elements 20 have top portions 22 and the plurality of captivating sleeves 18 have bottom portions 24. In a preferred embodiment, the top portions 22 of the antenna elements 20 are attached to the top housing portion 14 and the bottom portions 24 of the captivating sleeves 18 are attached to the bottom housing portion 16. Relative motion between the top housing portion 14 and the bottom housing portion 16 will cause the antenna elements 20 to expand or contract. For example, when the top housing portion 14 is pulled away from the bottom housing portion 16, the antenna elements 20 will expand to an open position. Similarly, when the top housing portion 14 is compressed toward the bottom housing portion 16, the antenna elements 20 will collapse to a closed position.

One embodiment of the antenna elements 20 is shown in FIGS. 1 and 2. In this embodiment, the antenna elements 20 are one-piece, continuous rods. When the antenna assembly 10 is closed, the antenna elements 20 are maintained within the captivating sleeves 18 and within the bottom housing portion 16. In a preferred embodiment, the bottom housing portion 16 contains a plurality of isolation standoff guides 42. The standoff guides 42 act as sleeves for the elements 20 within the bottom housing portion 16 and allow the antenna elements 20 to travel through the circuit boards 26, 28, 30 in the bottom housing portion 16 without the possibility of the circuit boards 26, 28, 30 impinging the motion of the elements 20. When the antenna assembly 10 is expanded or collapsed in this embodiment, the antenna elements 20 travel through the antenna housings 48 and the isolation standoff guides 42.

The antenna elements 20 can be connected to the captive antenna circuit board 26. In one embodiment, the antenna elements 20 are connected to the antenna circuit board 26 along a conductive signal path 44 shown in FIG. 2. In a preferred embodiment, the antenna elements 20 are connected to the antenna circuit board 26 by the conductive circuit path 44 when the antenna assembly 10 is placed in an open position. Conversely in this embodiment, when the antenna assembly 10 is placed in a closed position, there is no connection between the antenna elements 20 and the antenna circuit board 26, thereby disabling the antenna elements 20.

The antenna assembly 10 can have a first securing mechanism 34 to secure the top housing portion 14 to the bottom housing portion 16 when the assembly 10 is closed. In a preferred embodiment, the first securing mechanism 34 is a locking device. For example, the first securing mechanism 34 can be a clip, as is shown in FIGS. 1 and 2. In this embodiment, as shown in FIG. 1, the clip is mounted to the top housing portion 14 and attaches to the captivating sleeves 18 of the antenna elements 20 when the top housing portion 14 is collapsed against the bottom housing portion 16. The first securing mechanism 34 can be a friction fit between the antenna elements 20 and the top housing portion 14, in an alternate embodiment.

The antenna assembly 10 can also have a second securing mechanism 36 to secure the top housing portion 14 away from the bottom housing portion 16 when the assembly 10 is opened. The second securing mechanism 36 can be created by a friction contact between the antenna elements 20 and the captivating sleeves 18. In a preferred embodiment, the friction contact is a snap-down, snap-up contact. In this embodiment, the antenna elements 20 each have a friction mechanism, such as a flared ball, attached to the ends of the elements 20 that are mounted within the bottom housing portion 16. As the elements 20 are expanded, each friction mechanism can enter the antenna housings 48 and create a friction fit between the elements 20 and the housings 48. In an alternate embodiment, the second securing mechanism 36 can be a locking device such as a clip or a snap, for example.

The top housing portion 14 can have a thickness between 0.4 and 0.8 inches. In a preferred embodiment, the top housing portion 14 has a thickness of 0.6 inches. The bottom housing portion 16 can have a thickness between 0.5 and 1.0 inches. In a preferred embodiment, the bottom housing portion 16 has a thickness of 0.77 inches.

In an embodiment of the invention, when the antenna assembly 10 is expanded or opened, the top housing portion 14 of the antenna assembly 10 has a height between 1.3 inches and 1.8 inches. In a preferred embodiment, the height of the top housing portion 14 the antenna assembly 10, in an expanded position, is 1.49 inches.

In another embodiment of the invention, when the antenna assembly 10 is closed or collapsed, the antenna assembly 10 has a height between 1.25 inches and 1.4 inches. In a preferred embodiment, the height of the antenna assembly 10 is 1.37 inches in a closed or collapsed position.

The antenna elements 20 can have a range of motion between 0.48 inches and 1.28 inches when the antenna assembly 10 is moved from a closed to an open position or from an open to a closed position. In a preferred embodiment, the antenna elements 20 have a range of motion of 0.88 inches.

Each portion of the housing 12, which includes both the top housing portion 14 and the bottom housing portion 16, can be made from a molded material. In one embodiment, each portion 14,16 of the housing 12 is made of a molded plastic. The bottom housing portion 16 can have a base 38 and a cap 40. The base 38 or the cap 40 can be made from a molded material. The bottom housing portion 16 can also have a tapered edge 50 where the width of the bottom housing portion 16 increases from cap 40 to base 38. In one embodiment, the cap 40 can have a width between 3.6 and 5.6 inches. In a preferred embodiment the cap 40 can have a width of 4.6 inches. In one embodiment, the base 38 can have a width of between 3.93 inches and 5.93 inches. In a preferred embodiment, the base 38 has a width of 4.93 inches.

Figure 3:
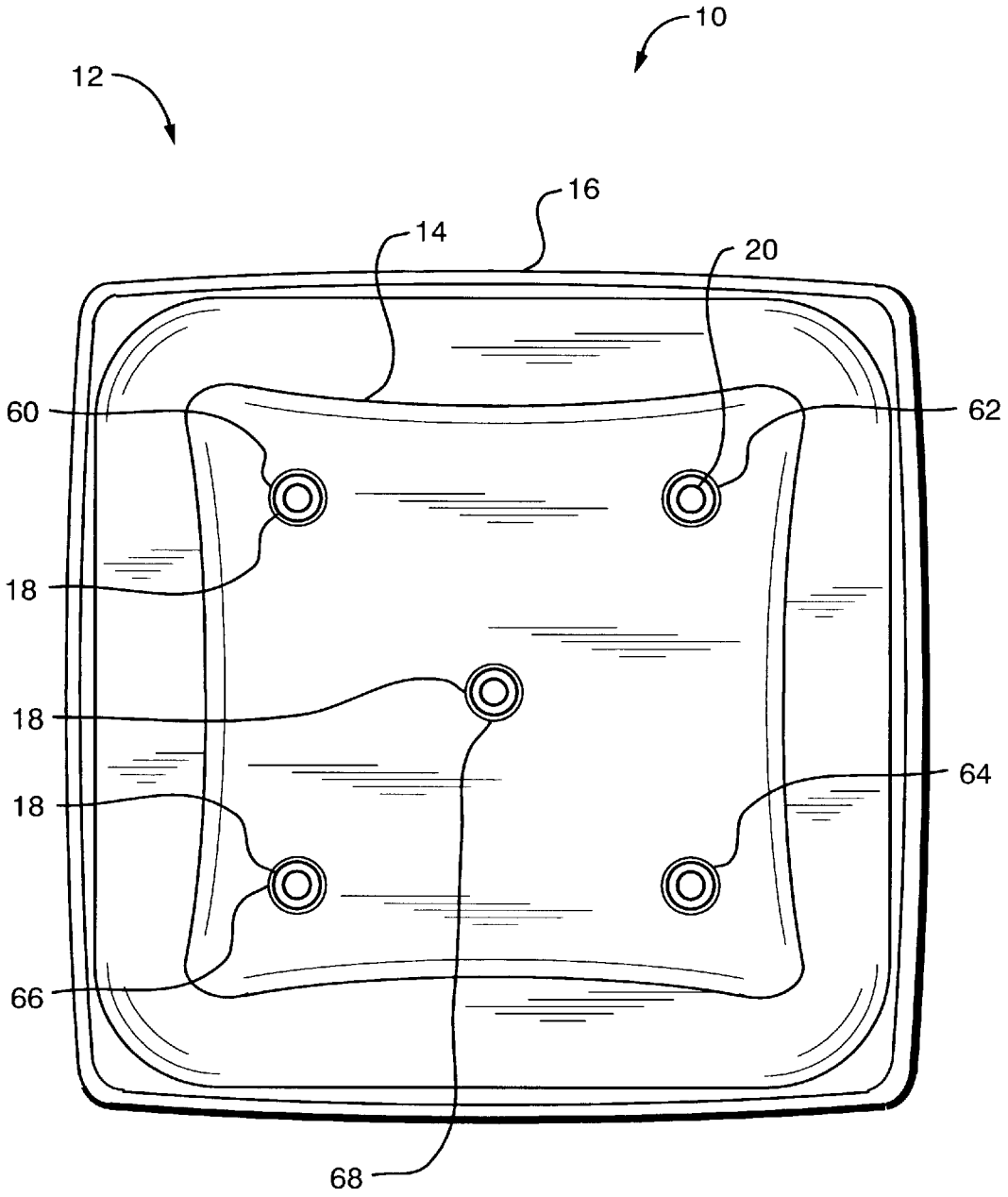
FIG. 3 illustrates a top view of an embodiment of an antenna assembly.
Figure 4:
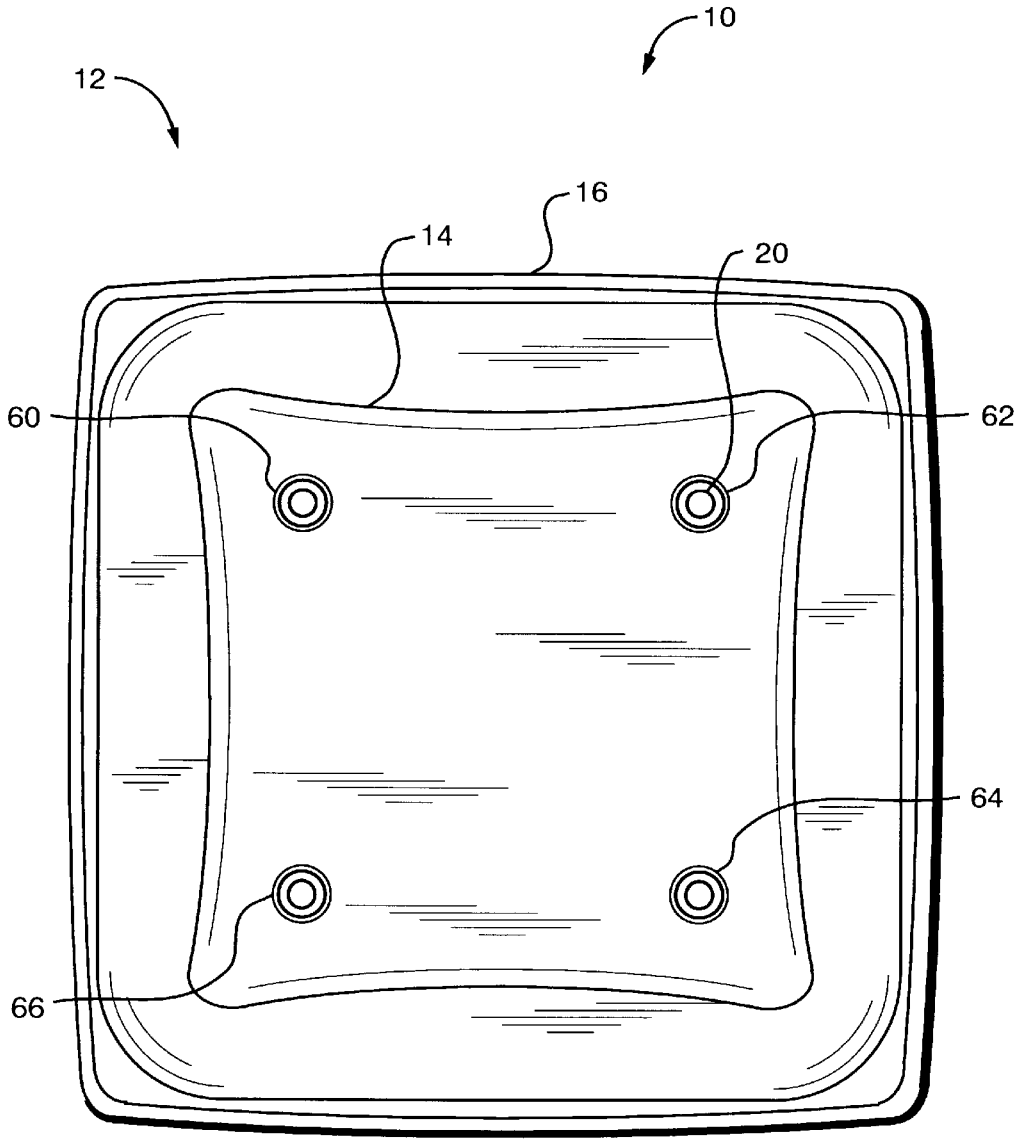
FIG. 4 shows an alternate embodiment of the antenna assembly shown in FIG. 3.

FIG. 3 illustrates an embodiment of the antenna assembly showing the positioning of antenna elements 20 in the housing 12. In a preferred embodiment, there are five antenna elements 20 within the housing 12. In another preferred embodiment, the antenna elements 20 are arranged such that a first antenna 60, a second antenna 62, a third antenna 64 and a fourth antenna 66 are positioned within the housing at locations corresponding to the comers of a square and a fifth antenna 68 is positioned within the housing at a location corresponding to the center of a square. An alternate embodiment of the antenna positioning is shown in FIG. 4. In this embodiment, the plurality of antenna elements has four elements 20, including a first antenna 60, a second antenna 62, a third antenna 64 and a fourth antenna 66. Each of the elements 20 can be positioned within the housing at locations corresponding to the four comers of a square. In this alternate embodiment, the size of the four antennae 60, 62, 64, 66 is smaller along the longitudinal axis and radial axis, compared to the size of the antennae when the plurality of antenna elements has five antenna elements.

In another embodiment of the invention, the antenna elements are telescoping antenna elements 70. In this embodiment, the antenna elements 20 have a plurality of concentric elements 76. When the antenna assembly 10 is opened or closed, the thinner concentric elements 78 can slide relative to the thicker concentric elements 80. The concentric elements 76 expand and collapse when the antenna assembly 10 is opened and closed, respectively.

Figure 5:
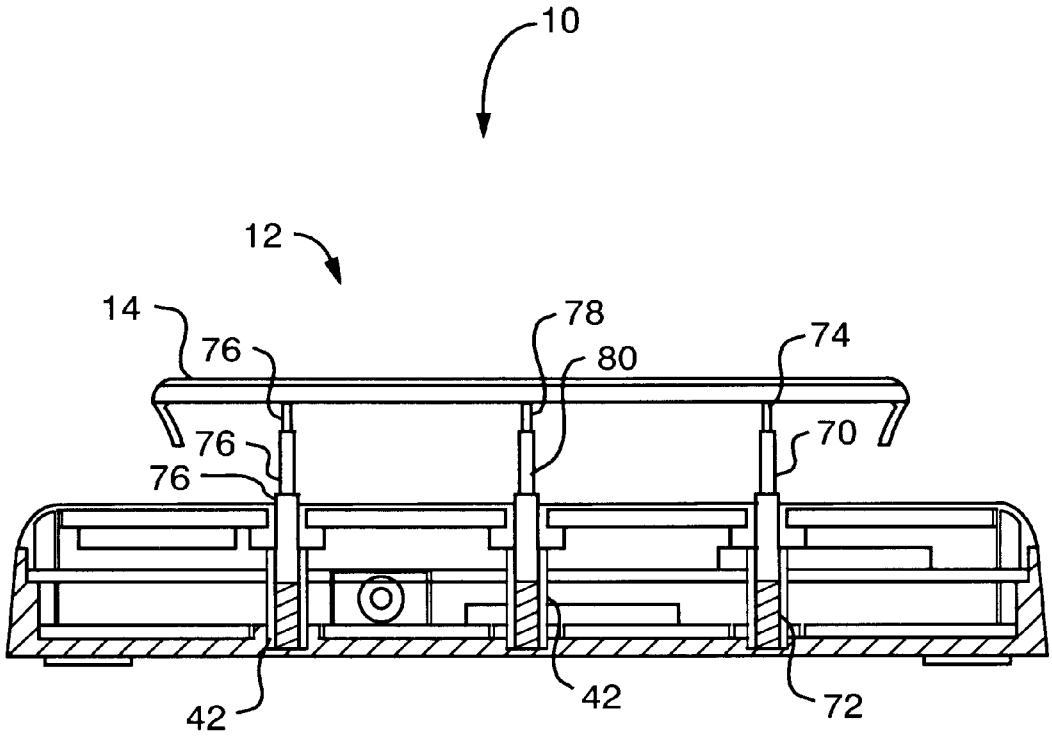
FIG. 5 illustrates an alternate embodiment of the antenna assembly shown in FIG. 1.

FIG. 5 illustrates one embodiment of the telescoping antenna elements 70. This embodiment of the assembly 10 is shown in a partially opened configuration. In this embodiment, the elements 70 are slidably mounted within the assembly 10 and are maintained within the isolation antenna guides 42 within the housing 12. The telescoping antenna elements 70 can have base portions 72 located in the isolation antenna guides 42 and top portions 74 attached to the top housing portion 14. The top portions 74 of the telescoping elements 70 can be thinner than the base portions 72. In this embodiment, the elements 70 both telescope from and slide through the housing 12. In this embodiment, the antenna assembly 10 can have a securing mechanism to secure the top housing portion 14 away from the bottom housing portion 16 when the assembly 10 is opened or to secure the top housing portion 14 against the bottom housing portion 16 when the assembly 10 is closed. The securing mechanism can be created by a friction contact among the concentric antenna elements 76.

Figure 6:
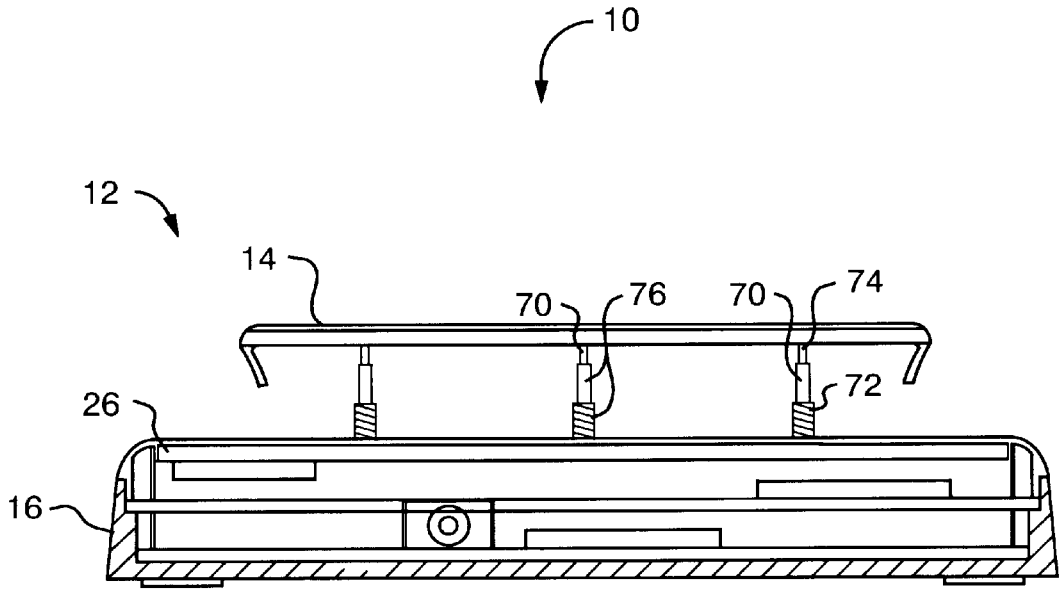
FIG. 6 illustrates another alternate embodiment of the antenna assembly shown in FIG. 1.

FIG. 6 illustrates an alternate embodiment of the telescoping antenna elements 70, shown in a partially opened configuration. In this embodiment, the elements 70 are maintained on the bottom housing portion 16. The elements 70 do not slide through the housing 12. The top portions 74 of the antenna elements 70 can be fixedly attached to the top housing portion 14 of the housing 12. The antenna elements 70 can have base portions 72 attached to the bottom housing portion and connected to the antenna circuit board 26. The elements 70 can telescope from the bottom housing portion 16 when the top housing portion 14 is moved to an expanded state. In this embodiment, the antenna assembly 10 can have a securing mechanism to secure the top housing portion 14 away from the bottom housing portion 16 when the assembly 10 is opened secure the top housing portion 14 against the bottom housing portion 16 when the assembly 10 is closed. The securing mechanism can be created by a friction contact among the concentric antenna elements 76.

Figure 7:
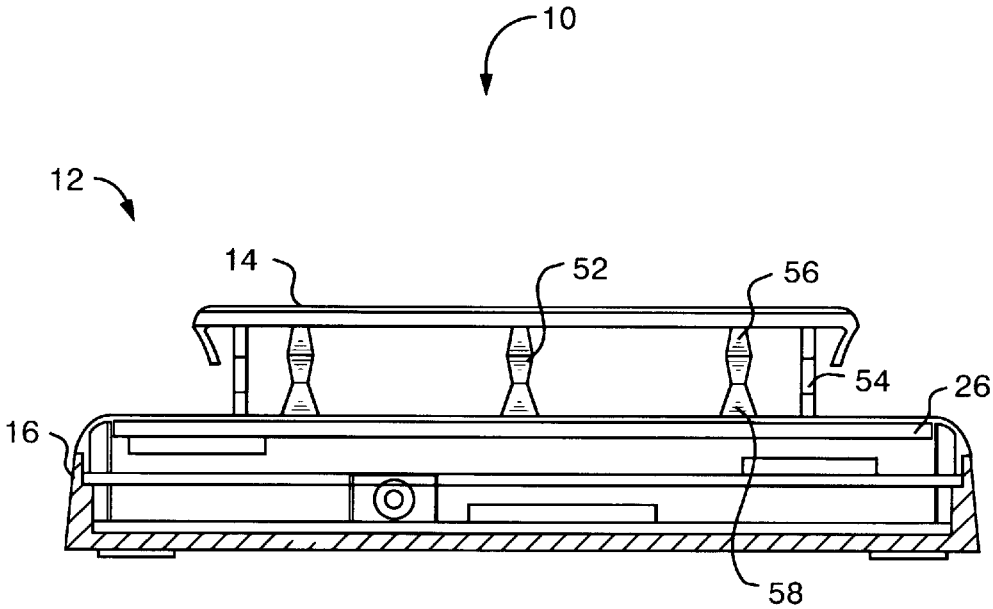
FIG. 7 illustrates another alternate embodiment of the antenna assembly shown in FIG. 1.

FIG. 7 shows an embodiment of the antenna assembly 10 where the antenna elements 20 are made from a flex circuit material. FIG. 7 shows the assembly 10 in a partially opened configuration. In a preferred embodiment, the flex circuit material forms an accordion antenna 52. Flex circuit material can be folded to form an accordion shape which, in turn, can be used as the accordion antenna 52. The accordion antenna 52 can have a top portion 56 and a bottom portion 58. The top portion 56 of the accordion antenna 52 can be attached to the top housing portion 14 while the bottom portion 58 can be fixedly attached to the bottom housing portion 16 and connected to the antenna circuit board 26. Also in this embodiment, the assembly 10 contains a plurality of support rails 54. Because the antennae 52 are made from a flex material, the support rails 54 are needed as a mechanical support to secure the top housing portion 14 to the bottom housing portion 16. The support rails 54 can also allow for motion between the top housing portion 13 and the bottom housing portion 16. In a preferred embodiment, the support rails 54 are telescoping rails. The support rails 54 can also act to maintain the top housing portion 14 of the housing 12 in an open position or a closed position relative to the bottom housing portion 16. A friction contact among the elements of the telescoping rails can be used to secure the assembly 10 in an open position, in one embodiment.

Figure 8:
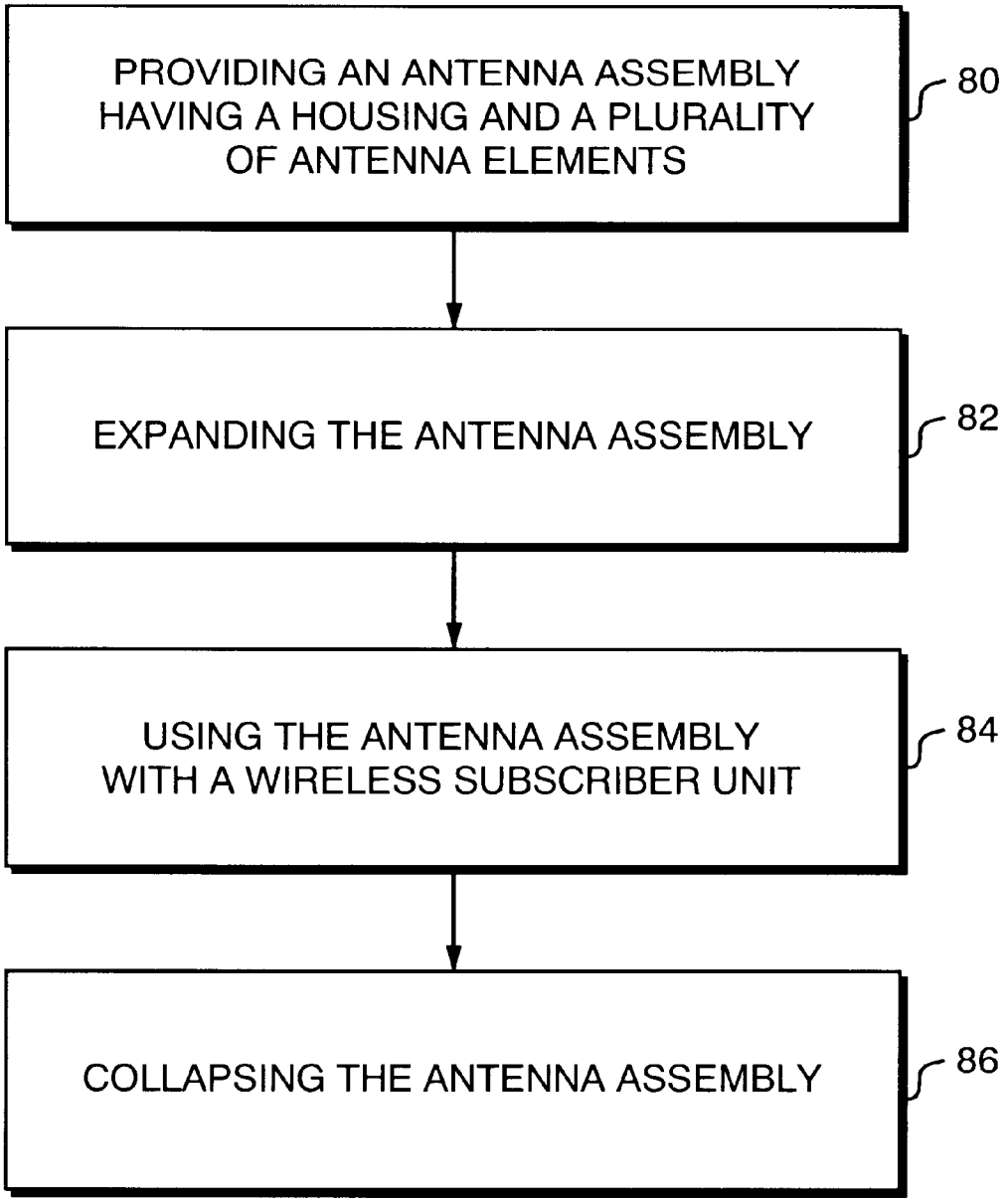
FIG. 8 is a chart outlining a method for using an antenna assembly.

FIG. 8 shows steps relating to a method of using an antenna assembly. An antenna assembly having a housing and a plurality of antenna elements is first provided 80. Next, the antenna assembly is expanded 82. Expanding the antenna assembly allows a user to receive data from a wireless subscriber unit 84. When the user is finished, the last step includes collapsing the antenna assembly 86. This allows the user to transport the antenna assembly without risk of damage to the antenna elements. The method of using an antenna assembly can further include the step of locking the antenna assembly in an expanded state. This step insures that the antenna elements are maintained in an expanded position during use of the antenna assembly. The method of using an antenna assembly can also include the step of locking the housing in a collapsed state. This step insures that the antenna elements are maintained in an collapsed position during use of the antenna assembly.

While this invention has been particularly shown and described with references to preferred embodiments thereof, it will be understood by those skilled in the art that various changes in form and details may be made therein without departing from the scope of the invention encompassed by the appended claims.

What is claimed is:

1. An antenna assembly for use with a wireless subscriber unit comprising:

a housing having a top housing portion and a bottom housing portion; and a plurality of antenna elements having a top and a bottom, the top of the antenna elements attached to the top housing portion and the bottom of the antenna elements slidably mounted within the bottom housing portion such that expanding the top housing portion from the bottom housing portion expands the antenna elements and collapsing the top housing portion toward the bottom housing portion collapses the antenna elements.

2. The antenna assembly of claim 1 wherein the antenna assembly further comprises at least one circuit board mounted within the housing.

3. The antenna assembly of claim 1 wherein the antenna assembly further comprises a captive antenna circuit board, a captive modem controller circuit board and a captive transceiver circuit board.

4. The antenna assembly of claim 1 wherein the antenna assembly further comprises a port.

5. The antenna assembly of claim 1 wherein the antenna assembly further comprises a first securing mechanism to secure the top housing portion to the bottom housing portion when the antenna assembly is placed in a closed position.

6. The antenna assembly of claim 1 wherein the antenna assembly further comprises a second securing mechanism to secure the top housing portion away from the bottom housing portion when the antenna assembly is placed in an open position.

7. The antenna assembly of claim 1 wherein the plurality of antenna elements further comprise a plurality of captivating sleeves.

8. The antenna assembly of claim 1 wherein the plurality of antenna elements comprises five antenna elements.

9. The antenna assembly of claim 8 wherein a first antenna, a second antenna, a third antenna and a fourth antenna of the five antenna elements are positioned within the housing at locations corresponding to the corners of a square and a fifth antenna of the five antenna elements is positioned within the housing at a location corresponding to the center of a square.

10. The antenna assembly of claim 1 wherein the plurality of antenna elements comprises four antenna elements.

11. The antenna assembly of claim 10 wherein a first antenna, a second antenna, a third antenna and a fourth antenna of the four antenna elements are positioned within the housing at locations corresponding to the corners of a square.

12. The antenna assembly of claim 1 wherein the antenna elements comprise continuous rods.

13. The antenna assembly of claim 1 wherein the antenna elements comprise telescoping elements.

14. An antenna assembly for use with a wireless subscriber unit comprising:

a housing having a top housing portion and a bottom housing portion; and a plurality of antenna elements having a top and a bottom, the top of the antenna elements attached to the top housing portion and the bottom of the antenna elements fixedly attached to the bottom housing portion such that expanding the top housing portion from the bottom housing portion expands the antenna elements and collapsing the top housing portion toward the bottom housing portion collapses the antenna elements.

15. The antenna assembly of claim 14 wherein the antenna assembly further comprises at least one circuit board mounted within the housing.

16. The antenna assembly of claim 14 wherein the antenna assembly further comprises a captive antenna circuit board, a captive modem controller circuit board and a captive transceiver circuit board.

17. The antenna assembly of claim 14 wherein the antenna assembly further comprises a port.

18. The antenna assembly of claim 14 wherein the antenna assembly further comprises a securing mechanism to secure the top housing portion to the bottom housing portion when the antenna assembly is placed in a closed position and to secure the top housing portion away from the bottom housing portion when the antenna assembly is placed in an open position.

19. The antenna assembly of claim 14 wherein the plurality of antenna elements comprises five antenna elements.

20. The antenna assembly of claim 19 wherein a first antenna, a second antenna, a third antenna and a fourth antenna of the five antenna elements are positioned within the housing at locations corresponding to the corners of a square and a fifth antenna of the five antenna elements is positioned within the housing at a location corresponding to the center of a square.

21. The antenna assembly of claim 14 wherein the plurality of antenna elements comprises four antenna elements.

22. The antenna assembly of claim 21 wherein a first antenna, a second antenna, a third antenna and a fourth antenna of the four antenna elements are positioned within the housing at locations corresponding to the corners of a square.

23. The antenna assembly of claim 14 wherein the antenna elements comprise telescoping elements.

24. The antenna assembly of claim 14 wherein the plurality of antenna elements comprise a flex circuit material.

25. The antenna assembly of claim 24 wherein the flex circuit forms an accordion antenna.

26. The antenna assembly of claim 24 further comprising a plurality of support rails.

* * * * *